US005664378A

United States Patent [19]

Bettigole et al.

[11] Patent Number: 5,664,378

[45] **Date of Patent: *Sep. 9, 1997**

[54] EXODERMIC DECK SYSTEM

[76] Inventors: Robert A. Bettigole, 21 Robin Hill Rd., Scarsdale, N.Y. 10583; Neal H. Bettigole, 89 Howard Dr., Old Tappan, N.J. 07675

[ * ] Notice: The term of this patent shall not extend beyond the expiration date of Pat. No. 5,509,243.

[21] Appl. No.: 568,464

[22] Filed: Dec. 7, 1995

[51] Int. Cl.[6] ..... E04B 1/18

[52] U.S. Cl. ..... 52/414; 52/333; 52/334; 52/335; 52/337; 404/70; 404/134

[58] Field of Search ..... 52/334, 335, 333, 52/337, 740.6, 740.8, 414; 14/73, 74.5; 404/70, 134

[56] References Cited

U.S. PATENT DOCUMENTS

| | | | |
|---|---|---|---|
| 185,302 | 12/1876 | Davison . | |
| 1,033,106 | 7/1912 | Kahn . | |
| 1,300,439 | 4/1919 | Madison . | |
| 1,613,063 | 1/1927 | Stark . | |
| 1,818,299 | 8/1931 | Bowman | 52/335 |
| 1,936,536 | 11/1933 | Bates . | |
| 1,964,944 | 12/1934 | Picirilli . | |
| 2,053,135 | 9/1936 | Dalton . | |
| 2,064,910 | 12/1936 | Harper | 52/335 |
| 2,096,629 | 10/1937 | Farrar et al. . | |
| 2,128,753 | 8/1938 | Lienhard . | |
| 2,162,742 | 6/1939 | Nagin . | |
| 2,184,146 | 12/1939 | Leguillon . | |
| 2,190,214 | 2/1940 | Nagin . | |
| 2,233,054 | 2/1941 | Heeren . | |
| 2,246,766 | 6/1941 | Tarof . | |
| 2,307,869 | 1/1943 | Tench . | |
| 2,437,095 | 3/1948 | Kahr . | |
| 2,645,985 | 7/1953 | Beebe et al. . | |
| 2,834,267 | 5/1958 | Beebe . | |
| 2,880,116 | 3/1959 | Alps et al. . | |
| 3,110,049 | 11/1963 | Nagin . | |
| 3,110,981 | 11/1963 | Larner . | |
| 3,253,289 | 5/1966 | Nagin . | |
| 3,260,023 | 7/1966 | Nagin . | |
| 3,269,071 | 8/1966 | Johnson . | |
| 3,305,991 | 2/1967 | Weismann . | |

(List continued on next page.)

FOREIGN PATENT DOCUMENTS

| | | |
|---|---|---|
| 1377320 | 9/1964 | France . |

OTHER PUBLICATIONS

"Exodermic Bridge Deck" brochure (1996) published by the Exodermic Bridge Deck Institue, Inc.

Brochure: Greulich Bridge Flooring Systems, Easco Industrial Products, pp. 3–15, 1982.

Composite Construction in Steel and Concrete, "Recent Designs of Composite Bridges and a New Type of Shear Connectors", Wilhelm Zellner, M. ASCE, New England College, Henniker, New Hampshire, Jun. 7–12, 1987, Published by American Society of Civil Engineers, New York, New York.

*Primary Examiner*—Christopher T. Kent

*Attorney, Agent, or Firm*—Cushman Darby & Cushman IP Group of Pillsbury Madison & Sutro, LLP

[57] ABSTRACT

An exodermic deck for structural floors including bridge floors, road beds, pedestrian walkways, or the like, comprises a composite structure of a grid component and a top component. The grid component is preferably made of steel and includes a plurality of main bearing bars and a plurality of distribution bars oriented perpendicular to the main bearing bars. The top component is preferably made from reinforced concrete. The upper portions of either the main bearing bars or the distribution bars are embedded in the reinforced concrete component permitting horizontal shear transfer and creating a composite deck structure which maximizes the use of tensile strength of steel and the compressive strength of concrete. The top sections of the embedded bars have gripping surfaces for effecting mechanical locks between the grid component and the concrete component and increasing the horizontal shear transfer therebetween.

14 Claims, 5 Drawing Sheets

U.S. PATENT DOCUMENTS

| | | | |
|---|---|---|---|
| 3,363,379 | 1/1968 | Curran . | |
| 3,385,181 | 5/1968 | Stoll . | |
| 3,545,348 | 12/1970 | Anderson . | |
| 3,645,510 | 2/1972 | Klugman . | |
| 3,855,747 | 12/1974 | Langan . | |
| 3,906,571 | 9/1975 | Zetlin . | |
| 3,956,864 | 5/1976 | Fung . | |
| 4,102,102 | 7/1978 | Greulich . | |
| 4,112,640 | 9/1978 | Reifsnyder . | |
| 4,145,153 | 3/1979 | Fasullo et al. . | |
| 4,151,025 | 4/1979 | Jacobs . | |
| 4,151,694 | 5/1979 | Sriberg et al. | 52/335 X |
| 4,168,924 | 9/1979 | Draper et al. . | |
| 4,201,023 | 5/1980 | Jungbluth . | |
| 4,244,768 | 1/1981 | Wiechowski et al. . | |
| 4,271,555 | 6/1981 | Mingolla et al. . | |
| 4,282,619 | 8/1981 | Rooney . | |
| 4,300,320 | 11/1981 | Rooney . | |
| 4,486,996 | 12/1984 | Alejos . | |
| 4,531,857 | 7/1985 | Bettigole . | |
| 4,531,859 | 7/1985 | Bettigole . | |
| 4,653,237 | 3/1987 | Taft | 52/335 |
| 4,660,341 | 4/1987 | Holtz . | |
| 4,700,519 | 10/1987 | Person et al. . | |
| 4,727,704 | 3/1988 | Carlton . | |
| 4,780,021 | 10/1988 | Bettigole . | |
| 4,785,600 | 11/1988 | Ting . | |
| 4,865,486 | 9/1989 | Bettigole . | |
| 5,339,475 | 8/1994 | Jaeger et al. . | |
| 5,509,243 | 4/1996 | Bettigole et al. | 52/334 |

FIG. 4C
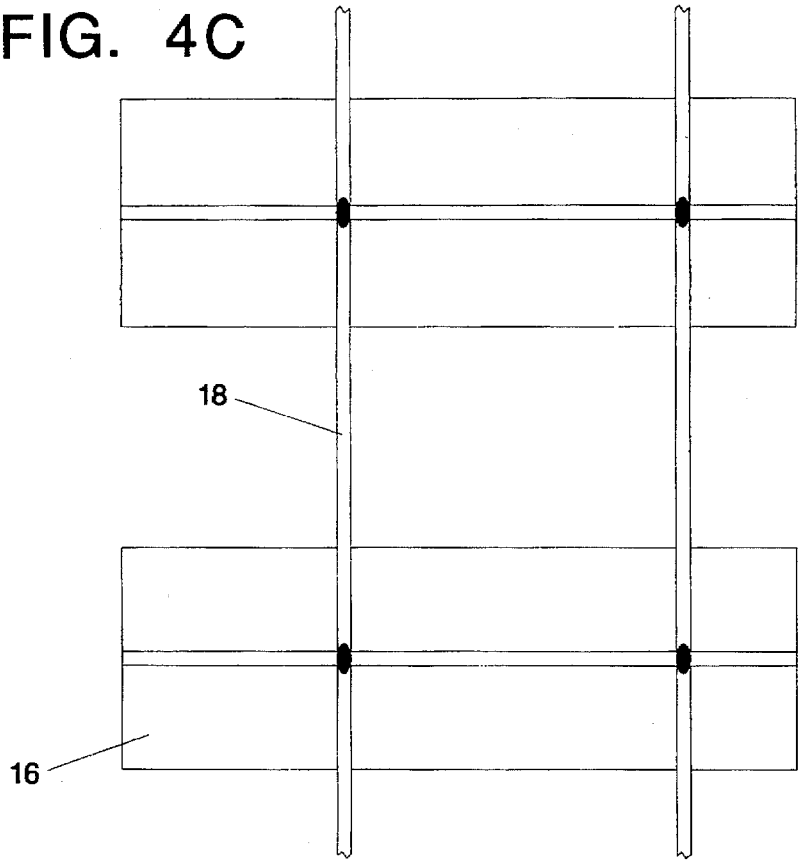
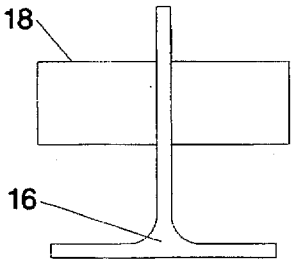
FIG. 4A
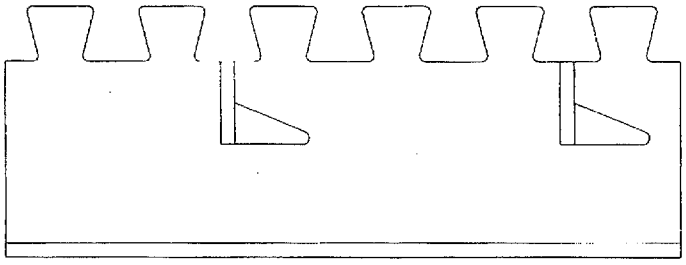
FIG. 4B

EXODERMIC DECK SYSTEM

TECHNICAL FIELD

The present invention relates to the improved construction of bridges, roads, and sidewalks. More particularly, the present invention relates to an improved exodermic deck and method of making an exodermic deck. Specifically, this invention relates to an improved shear connection between a grid and a concrete component. The improved shear connection provides improved composite interaction between the grid and the concrete component, simplifies construction of an exodermic deck, reduces the amount of steel used in the grid, and reduces the cost of an exodermic deck. This invention also relates to an improved method of manufacturing a shear connector for use with an exodermic bridge deck.

BACKGROUND OF THE INVENTION

The widespread deterioration of road structures, specifically bridges, has been acknowledged as a critical problem in our Nation's transportation system. The Federal Government considers hundreds of thousands of bridges structurally deficient or functionally obsolete. A major factor in the problems of bridges are the bridge decks, or roadway surfaces. The life span of the bridge deck averages only one half the service life of the other components of the average bridge.

The rehabilitation and redecking of existing deficient structures, as well as deck designs for new structures, must account for many factors affecting bridge construction and rehabilitation. These factors include increased usage, increased loading, reduced maintenance, increased use of salts for snow, and the need for lower costs, lighter weight, and more efficient construction techniques. Prior to the advent of exodermic decks, the available deck designs included some of these characteristics. None of the prior known devices, prior to exodermic decks, have all of the features required to meet current needs. U.S. Pat. Nos. 4,531,857, 4,531,859, 4,780,021, and 4,865,486 disclose exodermic decks and exodermic deck conversion methods which have met all the above design factors with unparalleled success.

An exodermic or unfilled, composite, steel grid deck consists of a concrete component and a grid component. Typically, the grid is made from steel, but other construction materials, such as aluminum or fiber-reinforced plastic, may be used. A reinforced concrete component is cast above an open, unfilled grid component forming a composite deck section. Shear transfer elements from the grid component are embedded into the concrete component providing the capability to transfer horizontal shear forces between the reinforced concrete component and the steel grid component and preventing vertical separation between the concrete component and the steel grid component. This arrangement allows an exodermic deck to achieve enhanced composite behavior.

An exodermic deck maximizes the use of the compressive strength of concrete and the tensile strength of steel to significantly increase the deck section properties over that of known conventional deck constructions of equal weight. The advantages achieved by exodermic decks also include reduced weight, rapid installation, increased strength, longer expected life and increased design flexibility.

Exodermic decks can be lighter than conventional decks of comparable load design. This reduction of weight results in significant savings on new steel framing and substructures and significantly upgrades the live load capacity of existing bridges. A further benefit achieved by the reduction of weight is the favorable effect on the fatigue life of bridge members.

Structural testing to date has shown that exodermic decks can be expected to have a fatigue life in excess of other grid deck configurations at comparable load design capacities. In a typical exodermic construction, the neutral axis of the composite deck is relocated near the top of the grid component. This reduces the maximum stress level in the top surface of the grid component to a point at which fatigue failure should not occur. An exodermic deck eliminates potential fatigue failure thereby extending the useful life of the deck. Additionally, exedermic bridge decks can easily be designed for numerous varying size and strength requirements. Exodermic decks can be cast-in-place or prefabricated in sections and transported to the site for installation. A cast-in-place exodermic deck provides a continuous reinforced concrete surface which can be maintained in the same manner as any reinforced concrete deck, at significantly lower weight. Exodermic decks which are prefabricated in sections permit rapid installation and create the ability to utilize an off-site rigid quality control system for the deck.

Moreover, an exodermic deck eliminates skidding and noise problems commonly associated with open grid deck bridges and with filled grid deck bridges which do not have a wearing surface above the grid.

An exodermic deck design, used on all installations to date, includes a concrete component and a steel grid component comprised of main bearing bars, secondary or distribution bars, and tertiary bars. Short vertical dowels or studs are preferably welded to the tertiary bars. The top portion of the tertiary bars and the vertical dowels welded thereto are embedded in the concrete component to transfer the shear forces between the concrete component and the steel grid component and prevent any vertical separation between the concrete component and the steel grid component. Patent application Ser. No. 08/183,945 now U.S. Pat. No. 5,509,243 disclosed an alternative exodermic design which eliminated the need for tertiary bars. The present invention provides a further improvement which also eliminates the need for tertiary bars and the dowels or studs attached to the tertiary bars. The present invention further simplifies the steel grid component by eliminating the secondary or distribution bars, in one embodiment. Thus, an effective exodermic deck may be made according to the present invention with only a concrete component and main bearing bars including a top portion with functions as a shear connector between the main bearing bars and the concrete component.

SUMMARY OF THE INVENTION

This invention provides a new exodermic deck design which provides for improved shear connection between the grid component of an exodermic deck and the reinforced concrete component of an exodermic deck. The invention also provides for an improved method of manufacturing shear connectors for use on an exodermic deck. The invention further reduces the total number of welds required to fabricate a grid.

The present invention also eliminates the necessity for tertiary bars, which significantly reduces material and assembly costs. Even without tertiary bars, the invention still provides the unsurpassed strength and fatigue resistant properties associated with exodermic decks. In one form of the invention, the cross-bars may be eliminated, yet the deck will still provide acceptable strength and fatigue resistant properties for many applications.

The novel shear connectors of the invention, formed as part of the main bearing bar, form a mechanical lock between the grid component and the concrete component of the exodermic deck to provide improved composite interaction. The shear connectors of the invention are capable of resisting shear forces in three axes. The shear connectors can resist shear in a first horizontal axis transverse to the main bearing bars, a second horizontal axis parallel to the main bearing bars, and a third vertical axis perpendicular to the top surface of the main bearing bars.

In one form of the invention, the shear connectors are formed by a plurality of alternating dove-tail shaped projections and dove-tail shaped recesses. In another form of the invention, the shear connectors are formed by a solid shear connector bar with holes punched, cut, or drilled into the bar.

In either form of the invention, the main bearing bar with its integral shear connectors may be manufactured from an I-beam cut into the desired configuration. Each I-beam results in two T-shaped main bearing bars. When using the dove-tail shaped shear connectors, a dove-tail shaped cut is made along the length of the web of an I-beam, thus resulting in two T-shaped beams each having a top portion with the desired alternating dove-tail shaped projections and dove-tail shaped recesses. When using the shear connector with holes, two parallel rows of spaced holes are punched into a wide flange I-beam. A single, straight cut is made between the spaced parallel rows to result in two T-shaped beams each having a top portion with the desired shear connector structure.

In both forms of the invention, the exodermic deck is made so that the reinforced concrete component fills the holes or dove-tail of the main bearing bar recesses but does not fill the interstices of the grid. Thus, a portion of the main bearing bar penetrates the concrete component and functions as a shear connector element. This connection between the shear connectors on the grid and the concrete component provides a mechanical lock, provides shear transfer, and provides composite interaction between the grid and the concrete component.

Exodermic decks, like the type used in the present invention, generally are made from a grid having main bearing bars and distribution bars. The main bearing bars and the distribution bars are interconnected into a grid, with the distribution bars perpendicular to the main bearing bars.

In order to assemble the grid, the main bearing bars have fabrication holes punched into them. These fabrication holes are different from, and positioned differently from, the holes or recesses which define part of the shear connector. For clarity, the latter will be referred to as shear connector holes or shear connector recesses. The distribution bars are inserted through the fabrication holes and welded to the main bearing bars, to thereby form the grid structure.

The present invention provides a very efficient way of welding the distribution bars to the main bearing bars. In some applications, the present invention may reduce by approximately 50% the number of welds used. In one preferred form of the invention, the grid is constructed so that the tops of the distribution bars are substantially co-planar with the bottom surfaces of the openings in the shear connector. If the dove-tail shaped shear connector is used, the tops of the distribution bars are substantially co-planar with the bottom surfaces of the dove-tail shaped recesses. If the "punched hole" shear connector is used, the tops of the distribution bars are substantially co-planar with the bottom of the shear connector holes. Preferably a small fillet weld is used on each side of the main bearing bar. In some instances, however, depending on the location and height of the distribution bars, a single weld at the top surface of the distribution bar may be adequate. Moreover, the placement of the welds substantially simplifies the manufacturing process and thus reduces the cost for making a grid.

The present invention also may be constructed, however, with the tops of the distribution bars below the bottom surfaces of the dove-tail recesses or the shear connector holes.

In an alternative form of the invention, the exodermic deck can be simplified even further by eliminating the distribution bars. Thus, the "grid" is composed entirely of the main bearing bars. The top portion of the main bearing bars are embedded into the concrete component to form the exodermic deck. This provides a very light weight, inexpensive deck with acceptable strength for many applications. This alternative form of the invention can be made using techniques in which the main bearing bars are held in their desired position during manufacture, and wherein the concrete component holds the main bearing bars in position after assembly.

Although it is preferred to form the shear connectors as described above as part of the main bearing bars, alternatively, the shear connector portion can be formed as a separate component welded to the main bearing bars.

The bridge deck also includes a reinforced concrete component fixed to the grid or grating base member. Preferably, steel reinforcing bars, or rebars, are used, as is conventional. In the embodiment in which a dove-tail shear connector is used, the rebar may be placed in the dove-tail recess. The reinforced concrete component has a planar top surface and a planar bottom surface. The bottom surface is coplanar with the top faces of the distribution bars, when used, or in a similar position if the distribution bars are omitted, so that the concrete component does not fill the interstices of the grating base member.

The present invention provides a light weight, low cost, easily fabricated exodermic deck having an improved shear transfer structure. The shear connecting structure is embedded within the top component and is capable of resisting shear forces in three axes, including a first horizontal axis transverse to said main bearing bars, a second horizontal axis parallel to said main bearing bars, and a third vertical axis perpendicular to the top surface of the main bearing bars. The shear connectors thus provide a mechanical lock and effect shear transfer in the longitudinal direction, i.e., parallel to the bar having the shear connecting structure; provide a mechanical lock and effect shear transfer in the lateral direction, i.e., perpendicular to the bar having the shear connecting structure; and prevent vertical separation between the top component and the grating base member.

These and other benefits and features of the invention will be apparent upon consideration of the following detailed description of preferred embodiments thereof, presented in connection with the following drawings in which like reference numerals identify like elements throughout.

BRIEF DESCRIPTION OF THE DRAWINGS

FIG. 4A is a cross-section of a grid, including the beam shown in FIG. 3B assembled with a distribution bar;

FIG. 4B is a plan view of the grid shown in FIG. 4A;

FIG. 4C is a top plan view of the grid shown in FIG. 4A;

DETAILED DESCRIPTION OF THE PREFERRED EMBODIMENT

The invention disclosed and claimed herein comprises an exodermic deck, generally indicated at 10. Exodermic deck 10 is preferably intended to contact, be supported on, and transmit forces to support members 50 either directly or through a concrete haunch to form a structural floor which can be a bridge floor, a road bed, a pedestrian walkway, a support floor for a building, or the like. Exodermic deck 10 can be formed in-place or formed off-site in modular units and transported to the field and installed.

In its preferred form, exodermic deck 10 is a composite structure mainly comprised of an open-lattice grating base member or grid component 12, preferably made of steel, and a top component 14, preferably made of reinforced concrete. As described in more detail below, a portion of grid component 12 is embedded in top component 14 to advantageously transfer horizontal shear forces between concrete component 14 and grid component 12 and to maximize the benefits of the excellent compressive strength of concrete and the excellent tensile strength of steel.

Figure 1:
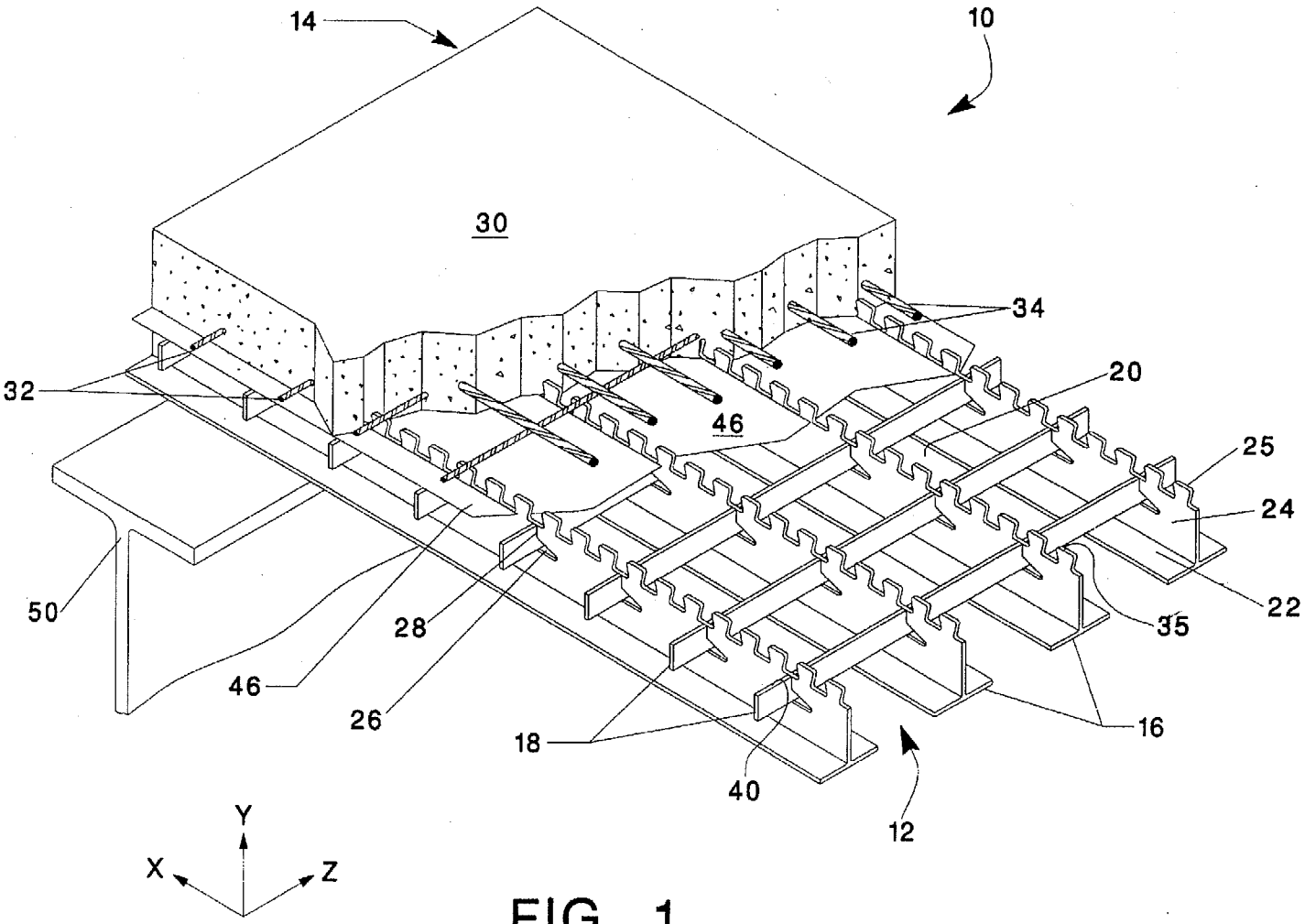
FIG. 1 is an isometric view of an exodermic deck.

As shown in FIG. 1, grid component 12 includes a plurality of substantially parallel main bearing bars 16 (shown as extending in the X-direction) and, in one form of the invention, a plurality of substantially parallel distribution bars 18 (shown as extending in the Y-direction) oriented perpendicular to main bearing bars 16. Main bearing bars 16 and distribution bars 18 intersect to define interstices 20 of grid component 12 therebetween. An aperture and slot assembly system, described hereinafter, permits distribution bars 18 to intersect and interlock with main bearing bars 16 and to distribute load transverse thereto.

In certain applications, it is possible to form the "grid" only from main bearing bars 16, and thereby eliminate cross-bars or distribution bars 18. In these applications, the deck will typically be pre-cast.

Figure 2:
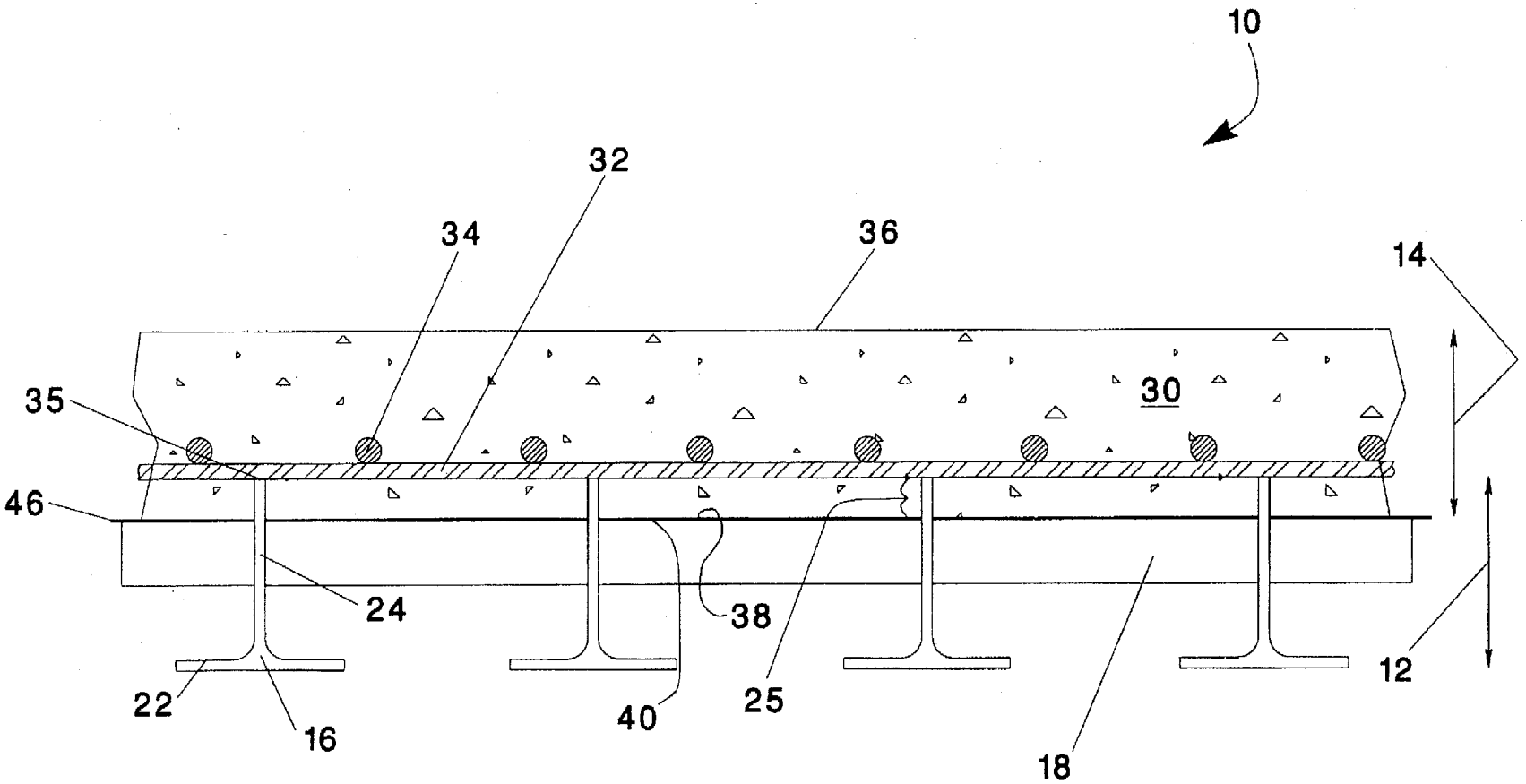
FIG. 2 is a cross-section of the deck shown in FIG. 1.

As best shown in FIG. 2, main bearing bars 16 are generally and most efficiently T-shaped and include a lower horizontal section 22, a substantially planar intermediate vertical section 24, and a top section 25. If distribution bars are used, assembly apertures or fabrication holes 26 are provided in intermediate vertical sections 24 of main bearing bars 16, and the number of assembly apertures 26 in each main bearing bar 16 corresponds to the number of distribution bars 18 utilized in grid component 12. If distribution bars are used, each distribution bar 18 is a flat bar including a number of spaced assembly slots 28 for interaction with assembly apertures 26 in main bearing bars 16 to permit the distribution bars 18 to be inserted horizontally through assembly apertures 26 and rotated to lie in a vertical plane. Assembly apertures 26 may also include grooves, not pictured, for retaining distribution bars 18 in the vertical position. Distribution bars 18 are welded, preferably using a simple plug weld at the top of the distribution bar, to main bearing bars 16 to maintain distribution bars 18 in the assembled position. A preferred aperture and slot assembly system is disclosed in U.S. Pat. No. 4,865,486, which is hereby incorporated by reference.

Top component 14 preferably consists of a material capable of being poured and setting, e.g., concrete 30. In the preferred design, concrete 30 is reinforced by a plurality of reinforcing bars, such as shown at 32, and a plurality of reinforcing bars, such as shown at 34. Typically, the reinforcing bars 32, 34 are oriented at right angles to each other, with one of the bars parallel to main bearing bars 16. However, in the orientation and embodiment shown in FIG. 1, bars 32 may be placed in the dove-tail recesses 25B as shown in FIG. 3C. Bars 32, 34 are preferably epoxy coated or galvanized to inhibit corrosion. However, in lieu of reinforcing bars 32, 34, a reinforcing mesh may be used to reinforce concrete 30.

Concrete component 14 includes a planar top surface 36 providing a road surface, either directly or with a separate wear surface, and a planar bottom surface 38 located proximate the top surfaces 40 of distribution bars 18, and encompasses embedded upper portions 25 of main bearing bars 16.

Embedded upper portions 25 permit mechanical locks to be formed between concrete component 14 and grid component 12 in the vertical direction (Z-axis), and in a horizontal plane in the longitudinal (X-axis) and lateral (Y-axis) directions. The mechanical locks: (i) assure longitudinal and lateral horizontal shear transfer from concrete component 14 to grid component 12, (ii) prevent separation between concrete component 14 and grid component 12 in the vertical direction, and (iii) provide structural continuity with concrete component 14, permitting concrete component 14 and grid component 12 to function in a composite fashion. While a small chemical bond may be formed due to the existence of adhesives in the concrete, without a mechanical lock in the longitudinal direction (X-axis), the longitudinal shear transfer is insufficient to permit concrete component 14 and grid component 12 to function in a totally composite fashion.

Top section 25 of main bearing bar 16 is shaped in the longitudinal direction (X-axis) to provide gripping surfaces. In one form of the invention, shown in FIGS. 3C and 4B, the top portion 25 of the main bearing bar is shaped with a plurality of alternating dove-tail projections 25A and dove-tail recesses 25B. The projections have a top surface 26, inwardly inclined side surfaces 28, and a bottom surface 30. Inwardly inclined side surfaces 28 of dove-tail projections 25A also define the side surfaces of dove-tail recesses 25B, as clearly shown in the drawings.

In the embodiment described above, in the Y-direction normal to the main bearing bar, the dove-tail projection 25A resists shear. In the X-direction parallel to the main bearing bar, the concrete component fills the dove-tail recess 25B. Shear resistance is provided by the edge or side wall 28. In the Z-direction, vertical separation is resisted by the upper, over hanging portion of projection 25A.

Figure 5A:
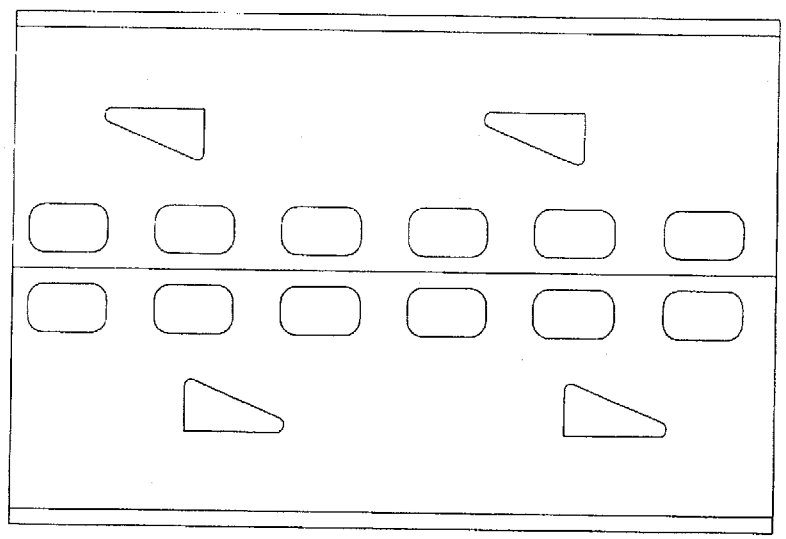
FIG. 5A is a plan view of an I-beam according to another form of the invention.
Figure 5:
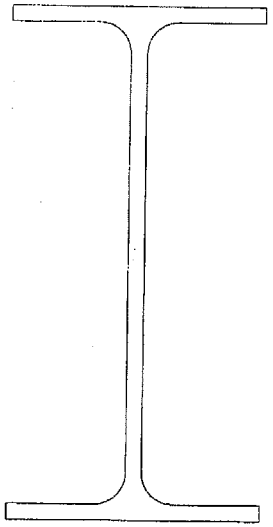
FIG. 5 is a cross-section of an I-beam.
Figure 5C:
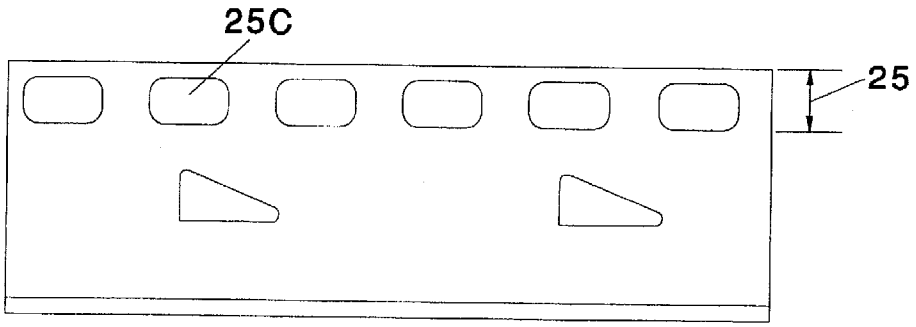
FIG. 5C is a plan view of the main bearing bar shown in FIG. 5B.
Figure 5B:
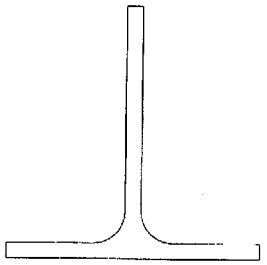
FIG. 5B is a cross-section of the beam shown in FIG. 5A after being cut to form a main bearing bar.

In an alternative form of the invention, as shown in FIG. 5C, the top portion 25 of the main bearing bar is formed with holes 25C. These holes provide a mechanical lock and effective shear transfer when embedded into the concrete layer of an exodermic deck in the manner similar to that described above.

Possible vertical (Z-axis) separation of concrete component 14 and grid component 12 is prevented by concrete engaging the underside of hole 25C. Enhanced horizontal shear transfer and mechanical locks in the longitudinal direction (X-axis) are achieved by the concrete filling the holes 25C and engaging the side walls of holes 25C. Horizontal shear transfer and mechanical locks in the lateral direction (Y-axis) are achieved by solid surfaces of upper portion 25 and the concrete being on both lateral sides of the upper portion 25.

Figure 3A:
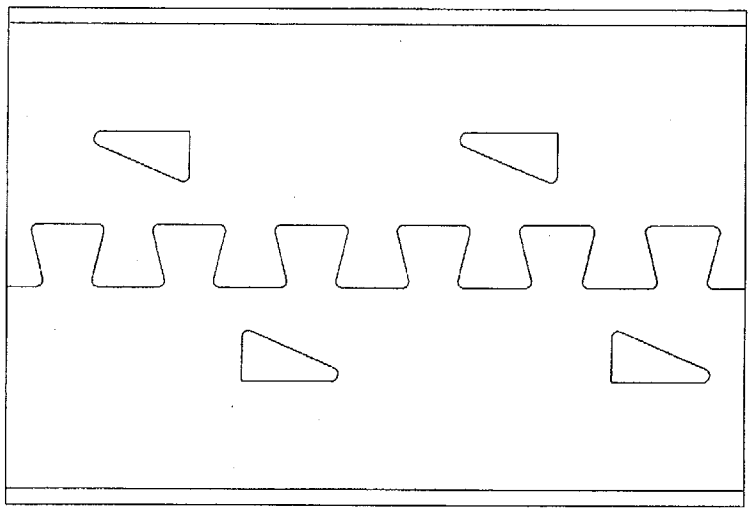
FIG. 3A is a plan view of an I-beam having a cut to form a shear connector according to one form of the invention.
Figure 3:
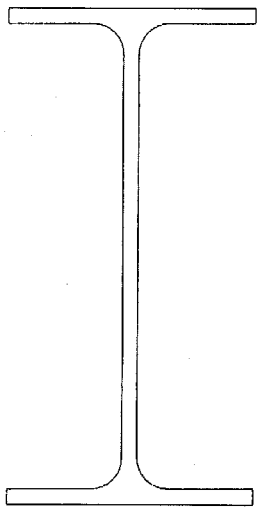
FIG. 3 is a cross-section of an I-beam prior to fabrication according to the invention.
Figure 3C:
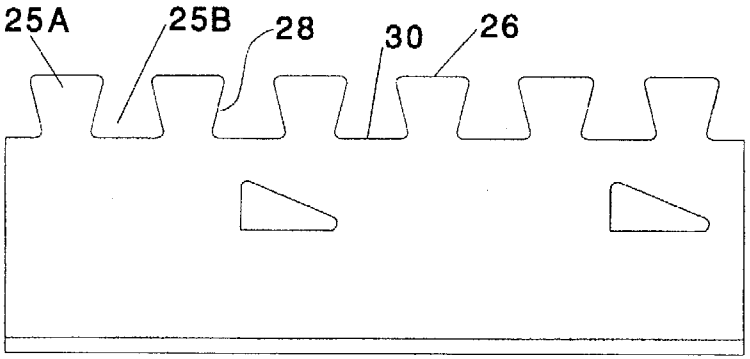
FIG. 3C is a plan view of the main bearing bar shown in FIG. 3B according to one form of the invention.
Figure 3B:
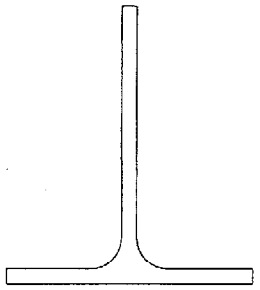
FIG. 3B is a cross-section of a beam after being cut and separated to form a main bearing bar according to one form of the invention.

One way of manufacturing the main bearing bears is shown in FIGS. 3A and 5A. As shown in FIG. 3A, an I-beam is cut, such as with a plasma cutter, with the desired dove-tail configuration. The 1-beam is then simply separated in half to form two T-shaped main bearing bars, each having the complementary shaped dove-tail top surface. Alternatively, when using the form of the invention shown in FIG. 5C, the I-beam is punched, cut, or drilled with two rows of parallel openings, as shown in FIG. 5A. The I-beam is then slit between the rows and separated in half to form two T-shaped main bearing bars.

To maximize deck strength and minimize deck weight, it is desirable that planar bottom surface 38 of concrete component 14 is generally coplanar with top surface 40 of distribution bars 18, when used, and that concrete 30 does not fill the interstices 20 of grid component 12. This feature can be achieved by a number of different methods.

In a preferred arrangement, intermediate barriers 46, e.g., strips of sheet metal, can be placed onto top surfaces 40 of distribution bars 18 between adjacent main bearing bars 16, as shown in FIG. 1. When concrete 30 or another material is subsequently poured onto grid component 12, intermediate barriers 46 create a barrier, preventing concrete 30 from travelling therethrough and filling interstices 20. Concrete 30 remains on intermediate barriers 46 creating planar bottom surface 38 of concrete component 14 which is generally coplanar with top surfaces 40 of distribution bars 18. However, in lieu of sheet metal strips, expanded metal laths, plastic sheets, fiberglass sheets, or other material can be used to create planar bottom surface 38. Additionally, biodegradable sheets, e.g., paper sheets, could also be used, as the primary purpose of intermediate barriers 46 is preventing concrete 30 from filling the interstices 20 of grid component 12, and this purpose is fully achieved once concrete 30 is cured.

Alternatively, planar bottom surface 38 of concrete component 14 can be formed by placing a lower barrier, e.g., a form board, underneath main bearing bars 16 and filling interstices 20 to a level substantially coplanar with the top surface 40 of distribution bars 18 with a temporary filler material, e.g., sand, plastic foam or other similar material. Concrete 30 may then be poured onto the temporary filler material and the temporary filler material will prevent concrete 30 from filling the interstices so that the bottom surface 38 of concrete component 14 is substantially coplanar with the top surface 40 of distribution bars 18. Once the concrete 30 is cured, the lower barrier and temporary filler material can be removed and the deck may be transported to site for installation. This technique is explained in U.S. Pat. Nos. 4,780,021 and 4,865,486 which are hereby incorporated by reference herein.

In the alternative, deck 10 can be formed by placing grid component 12 upside-down on top of concrete component 14, which would be inside a forming fixture, and to gently vibrate both components so that concrete component 14 cures to grid component 12 but does not penetrate and fill interstices 20 of grid component 12. One well-known method of vibrating the components is to use a shake table, but other vibrating devices and techniques may also be used.

Exodermic deck 10 is particularly advantageous because it is believed to possess the same or similar strength and fatigue life characteristics as existing exodermic decks having the same section modulus per unit of width, but deck 10 can be produced at a substantially lower cost. In an exodermic deck 10 designed to have the same section modulus per unit of width as an existing exodermic deck with tertiary bars and separate shear connectors, upper portion 25 of main bearing bars 16 would be increased in height to provide the desired shear connecting structure. Section modulus lost by the elimination of the tertiary bars would be compensated in the size and spacing of the main bearing bars 16 used. Most importantly, as exodermic deck 10 does not include tertiary bars or require separate vertical studs, the product cost of the tertiary bars and studs and the assembly costs of welding the studs to the tertiary bars and welding the tertiary bars to the distribution bars at each intersection is eliminated. If the distribution bars are eliminated from the "grid", there are even greater savings in costs and weight of materials, while providing acceptable performance for many applications.

By the elimination of the necessity for tertiary bars and studs, and perhaps the distribution bars, the additional objective of permitting automatic fabrication of the grid component is achieved. Automatic fabrication of grid components having main bearing bars, distribution bars, and tertiary bars, with or without studs, is not feasible due to technical and economic restraints created by the extra step or steps which are involved in attaching the tertiary bars to the distribution bars and the studs, if used, to the tertiary bars. By utilizing a grid component 12 having only main bearing bars 16, and perhaps distribution bars 18, automated assembly of grid component 12 is economically and technically feasible.

In a preferred embodiment, concrete component 14 is 4.5-inches thick concrete. Main bearing bars 16 are fabricated from 8-inch wide flange beams or beams of similar rolled shape, with the top portions thereof being shaped to provide gripping surfaces. Bearing bars 16 weigh approximately 6.5-lbs/linear foot and are spaced apart on 8-inch centers. Distribution bars 18 are 1.5-inch by ¼-inch bars and are spaced apart on 6-inch centers. In addition, the intermediate barriers 46 are 20-gauge galvanized sheet metal strips. However, it is recognized that one skilled in the art could vary these parameters to meet the design requirements associated with specific sites.

The concrete 30 used may be any standard structural concrete. One preferred concrete is a high density, low slump concrete because it serves as an additional barrier to prevent moisture from reaching steel grid component 12 and causing premature deterioration. A preferred coarse aggregate is ⅜-inch crushed stone. A typical low slump is approximately 1 inch. A latex modified concrete, as is well known in the an, could also be used as the top layer. Concrete component 14 may further include a macadam or similar material wear surface (not shown) applied on top of component 14. Other concrete formulations providing adequate compressive strength may also be used.

Main bearing bars 16, and distribution bars 18 are preferably hot rolled steel and may be either galvanized, coated with an epoxy, or otherwise protected from future deterioration. Such protective coatings are well known in the art and take the form of an organic, powdered epoxy resin applied to the grid by an electrostatic process. Galvanized, aluminum anodic and aluminum hot dip coatings are also well known and effective. In addition, or as an alternative, weathering steel, such as A588, may be used.

Specific characteristics of exodermic decks and details for manufacturing exodermic decks are disclosed in the Applicant's prior U.S. Pat. Nos. 4,531,857, 4,531,859, 4,780,021, and 4,865,486, which are hereby incorporated by reference.

If desired, shear members, such as vertically oriented studs or dowels, angles or channels, not shown, may be vertically attached to upper portions 25 of main bearing bars 16 to provide additional structure to be embedded into concrete component 14. Preferably, the studs would be welded to main bearing bars 16 before the insertion of distribution bars 18. Alternatively, the studs may be otherwise fixed to, or integrally formed with, main bearing bars 16. For increased effectiveness, the studs would extend upwardly above top surface 35 of main bearing bars 16. The studs enhance the horizontal shear transfer from concrete component 14 to grid component 12.

An alternate arrangement could be used in which the upper portions of distribution bars 18, with or without shear members attached thereto, extend above the top surfaces of main bearing bars 16 and are embedded in concrete component 14 instead of upper portions 25 of main bearing bars 16. In such an arrangement, top surfaces of main bearing bars 16 would provide the necessary supporting structure for intermediate barriers 46. Further, distribution bars 18 would preferably have an upper portion designed to include gripping surfaces for creating mechanical bonds and increasing the shear transfer between grid component 12 and concrete component 14.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention. For example, while the preferred materials used for grid component 12 and top component 14 are steel and concrete, respectively, fiber-reinforced plastic and an epoxy-aggregate, e.g., epoxy-concrete, could also respectively be used. In addition, grid component 12 and top component 14 could be made from other materials recognized to one of ordinary skill.

We claim:

1. A structural floor comprising:

an open lattice grating base member formed solely by a plurality of main bearing bars and a plurality of distribution bars, and without any tertiary bars, said distribution bars and said main bearing bars forming an integral grid, said distribution bars and main bearing bars positioned and spaced to define interstices therebetween, said distribution bars intersecting and interlocked with said main bearing bars to distribute load transverse to said main bearing bars;

a top component fixed to said grating base member, said top component having a planar top surface and a planar bottom surface, said planar bottom surface being parallel and proximate to the top surfaces of said plurality of distribution bars so that said top component does not fill the interstices of said grating base member;

each of said main bearing bars having an upper shear portion, said upper shear portions of said plurality of main bearing bars being embedded within said top component;

said plurality of main bearing bars further including means for forming a mechanical lock between said integral grid formed by said main bearing bars and said distribution bars and said top component when said upper shear transfer portions are embedded in said top component thereby preventing vertical separation between said top component and said grating base member;

said upper shear transfer portions of said main bearing bars effecting shear transfer between said top component and said grating base member in a horizontal direction parallel to said embedded main bearing bars and in a horizontal direction perpendicular to said embedded main bearing bars;

said means for forming a mechanical lock comprising shear connectors capable of resisting shear forces in three axes, including a first horizontal axis transverse to said main bearing bars, a second horizontal axis parallel to said main bearing bars, and a third vertical axis perpendicular to said main bearing bars;

said shear connectors comprise a plurality of dove-tail projections and dove-tail openings; and wherein said top component fills said dove-tail openings but does not penetrate said interstices between said main bearing bars and said distribution bars.

2. The structural floor as recited in claim 1, wherein said shear connectors are formed on shear connector bars, wherein said shear connector bars are substantially coextensive with said main bearing bars, and wherein said shear connector bars are fixed to said main bearing bars.

3. The structural floor as recited in claim 1, wherein said dove-tail openings have a bottom surface; and wherein the top of said distribution bars is substantially co-planar with said bottom surfaces of said dove-tail openings.

4. A structural floor comprising:

an open lattice grating base member formed solely by a plurality of main bearing bars and a plurality of distribution bars and without any tertiary bars, said distribution bars being substantially perpendicular to said main bearing bars, said distribution bars and said main bearing bars positioned and spaced to define interstices therebetween, said distribution bars intersecting and interlocked with said main bearing bars to distribute load transverse to said main bearing bars;

a top component fixed to said grating base member, said top component having a planar top surface and a planar bottom surface, said planar bottom surface being parallel and proximate to the top surfaces of said plurality of distribution bars so that said top component does not fill the interstices of said grating base member;

each of said main bearing bars having an upper portion, said upper portions of said plurality of main bearing bars being embedded within said top component;

said plurality of main bearing bars further including means for forming a mechanical lock between said base member and said top component when said upper portions of said main bearing bar are embedded in said top component thereby preventing vertical separation between said top component and said grating base member;

said upper portions of said main bearing bars effecting shear transfer between said top component and said grating base member in a horizontal direction parallel to said embedded main bearing bars and in a horizontal direction perpendicular to said embedded main bearing bars;

said means for forming a mechanical lock comprising shear connectors capable of resisting shear forces in three axes, including a first horizontal axis transverse to said main bearing bars, a second horizontal axis parallel to said main bearing bars, and a third vertical axis perpendicular to said main bearing bars;

said shear connectors comprise a plurality of spaced holes formed in said main bearing bar; and wherein said top component fills said spaced holes but does not penetrate said interstices between said main bearing bars and said distribution bars.

5. The structural floor as recited in claim 4, wherein said shear connectors are formed on shear connector bars, wherein said shear connector bars are substantially coextensive with said main bearing bars, and wherein said shear connector bars are fixed to said main bearing bars.

6. The structural floor as recited in claim 4, wherein said spaced holes have a bottom surface; and wherein the top of said distribution bars is substantially co-planar with said bottom surfaces of said spaced holes.

7. A structural floor consisting of:

an open grating base member formed solely by a plurality of main bearing bars and without distribution or tertiary bars, said main bearing bars spaced to define interstices therebetween, said main bearing bars having an upper portion and a bottom portion;

a top component fixed to said grating base member, said top component having a planar top surface and a planar bottom surface, said planar bottom surface of said top component being above the bottom portion of said main bearing bar so that said top component does not fill the interstices of said grating base member;

said upper portions of said plurality of main bearing bars being embedded within said top component, said plurality of main bearing bars further including means for forming a mechanical lock when embedded in said top component thereby preventing vertical separation between said top component and said grating base member;

said means for forming a mechanical lock effecting shear transfer between said top component and said grating base member in a horizontal direction parallel to said embedded main bearing bars and in a horizontal direction perpendicular to said embedded main bearing bars, and;

said means for forming a mechanical lock comprising shear connectors capable of resisting shear forces in three axes, including a first axis transverse to said main bearing bars, a second axis parallel to said main bearing bars, and a third axis perpendicular to said main bearing bars.

8. The structural floor as recited in claim 7, wherein said shear connectors comprise a plurality of spaced holes formed in said main bearing bar.

9. The structural floor as recited in claim 7, wherein said shear connectors comprise a plurality of dove-tail projections and dove-tail openings.

10. The structural floor as recited in claim 1, wherein said top component includes reinforcing bars and wherein at least one of said reinforcing bars is positioned within said dove-tail openings.

11. A structural floor comprising:

an open lattice grating base member formed solely by a plurality of main bearing bars and a plurality of distribution bars and without tertiary bars, said distribution bars being substantially perpendicular to said main bearing bars, said distribution bars and said main bearing bars positioned and spaced to define interstices therebetween;

said distribution bars intersecting and interlocked with said main bearing bars to distribute load transverse to said main bearing bars, said main bearing and distribution bars forming an integral unit;

a top component fixed to said grating base member, said top component having a planar top surface and a planar bottom surface, said bottom surface of said top component not filling the interstices of said grating base member;

upper portions of said distribution bars extending above the top surfaces of said main bearing bars and embedded in said top component.

12. The structural floor as recited in claim 11, wherein said distribution bars have an upper portion designed to include gripping surfaces for creating mechanical bonds and increasing the shear transfer between the grating base member and the top component.

13. The structural floor as recited in claim 12, wherein said gripping surfaces on said upper portion of said distribution bars comprise a plurality of dove-tail shear connectors.

14. The structural floor as recited in claim 12, wherein said gripping surfaces on said upper portion of said distribution bars comprise a plurality of shear connectors holes.

* * * * *